US008342437B2

(12) United States Patent
Antensteiner

(10) Patent No.: US 8,342,437 B2
(45) Date of Patent: Jan. 1, 2013

(54) DEFLAKER PLATE AND METHODS RELATING THERETO

(75) Inventor: Peter Antensteiner, Lewisburg, PA (US)

(73) Assignee: Andritz Inc., Glens Falls, NY (US)

( * ) Notice: Subject to any disclaimer, the term of this patent is extended or adjusted under 35 U.S.C. 154(b) by 322 days.

(21) Appl. No.: 12/750,980

(22) Filed: Mar. 31, 2010

(65) Prior Publication Data

US 2010/0269991 A1 Oct. 28, 2010

Related U.S. Application Data

(60) Provisional application No. 61/172,092, filed on Apr. 23, 2009.

(51) Int. Cl.
*B02C 7/12* (2006.01)

(52) U.S. Cl. ..... 241/261.3; 241/298

(58) Field of Classification Search ..... 241/261.2, 241/261.3, 296, 297, 298
See application file for complete search history.

(56) References Cited

U.S. PATENT DOCUMENTS 3,327,952 A 6/1967 Rosenfeld
5,683,048 A * 11/1997 Virving ..... 241/261.2

* cited by examiner

*Primary Examiner* — Mark Rosenbaum
(74) *Attorney, Agent, or Firm* — Nixon & Vanderhye P.C.

(57) ABSTRACT

A deflaker plate for use in a deflaker for reducing fibrous flakes in a slurry of fibers. The deflaker plate may include at least one annular ring consisting of multiple teeth, in which at least one tooth has a leading face, a trailing face, and an impact-generating side-face. The impact-generating side-face may be adapted to generate an impact force during operation, such that the force corresponds to a first vector radially pushing the slurry towards a center of the deflaker and a second vector tangentially pushing the slurry towards the leading face.

16 Claims, 8 Drawing Sheets

DEFLAKER PLATE AND METHODS RELATING THERETO

This application claims the benefit of priority to U.S. App. No. 61/172,092 filed on Apr. 23, 2009, the contents of which are incorporated herein by reference.

BACKGROUND OF THE INVENTION

This invention generally relates to systems and methods for flake reduction in fibrous materials. For example, the present invention may have particular applicability in the disintegration of fiber bundles in kraft or mechanical pulps and for recycled fibers as well as in flake reduction in broke handling systems.

Turning fibrous material (e.g., lignocellulosic material) or paper (e.g., broke) into individualized fibers generally involves disintegrating fiber mats into fibers under the influence of shear in a suspension environment. This may be accomplished, for example, in a mechanical refiner between two refiner plates. The repeated application of shear in the presence of water allows the fiber mat to dissolve the fibrous compound into smaller and smaller pieces until it has broken down to the individual fiber level. At that point a suspension may be called fully "fiberized."

The amount of time and energy used in the pulper to achieve the fully fiberized state, however, is usually prohibitive to the amount of production required of such central papermaking equipment. In reality, the prior to full fiberization. At this point, the non-fiberized parts remaining in the suspension—which are called "flakes"—are typically removed by a subsequent, specialized process. This specialized process can be faster and more efficient than pulping until fully fiberized.

This specialized process—which involves a deflaker—is known as deflaking. See, e.g., U.S. Pat. No. 3,327,952 to Rosenfeld. Deflaking describes a process where the rotary element of the deflaker turning against one or several stationary elements creates a field of hydraulic shear. This hydraulic shear may reduce the flake content of the suspension after pulping. Similar to the pulping effect there may be a need for repeated impulses on the flakes, such that the flakes may fully dissolve into singular fibers.

These pulses are generally delivered by so-called teeth on the rotor and stator plates in the deflaker, which generally either (a) pass or sweep aside each other along the generatrix of the machine similar to refiner plates (e.g., can be in the shape of a disc or a cone) or (b) intermesh in a more complicated fashion outside of the plane created by the generatrix of the machine.

The version (a) is relatively simple and may be done by refiner plates, spider web designs, or even plates consisting of holes. For example, no special requirements are needed—other than general parallelism of the contact planes between rotor and stator. Traditionally, the complex geometry of version (b) has required precision machining of the wear parts of the deflaker plates. Heretofore, this precise machining adequately solved the need for reliability and usability of these plates. But machining the plates involves higher manufacturing costs and a limit in the ability to specially design the opposing surfaces of the teeth.

That is, precision machining inherently places limits on the design of the deflaker plates. For instance, a machined deflaker plates can only have teeth in the shape of annular rings, because a lathe can only cut concentric circles into the plate. When the circles are cut, the inner and outer portions of the teeth form radians sharing the identical circle center.

Accordingly, there may exist a need in the art for a more effective configuration of deflaker plates. There may also exist a need in the art for deflaker plates that are not machined.

In an aspect, the present invention may overcome these extant deficiencies of the deflaker plate technology. For example, certain aspects of the present invention may involve the production of deflaker plates in a casting process and/or an improved design of the interfacing plate surfaces so as to facilitate improved (e.g., more efficient) deflaking.

SUMMARY OF THE INVENTION

In an aspect, the invention generally relates to a deflaker plate for use in a deflaker for reducing fibrous flakes in a slurry of fibers. The deflaker plate may include at least one annular ring consisting of multiple teeth, in which at least one tooth has a leading face, a trailing face, and an impact-generating side-face. The impact-generating side-face may be adapted to generate an impact force during operation, such that the force corresponds to a first vector radially pushing the slurry towards a center of the deflaker and a second vector tangentially pushing the slurry towards the leading face.

DETAILED DESCRIPTION OF THE INVENTION

Figure 1:
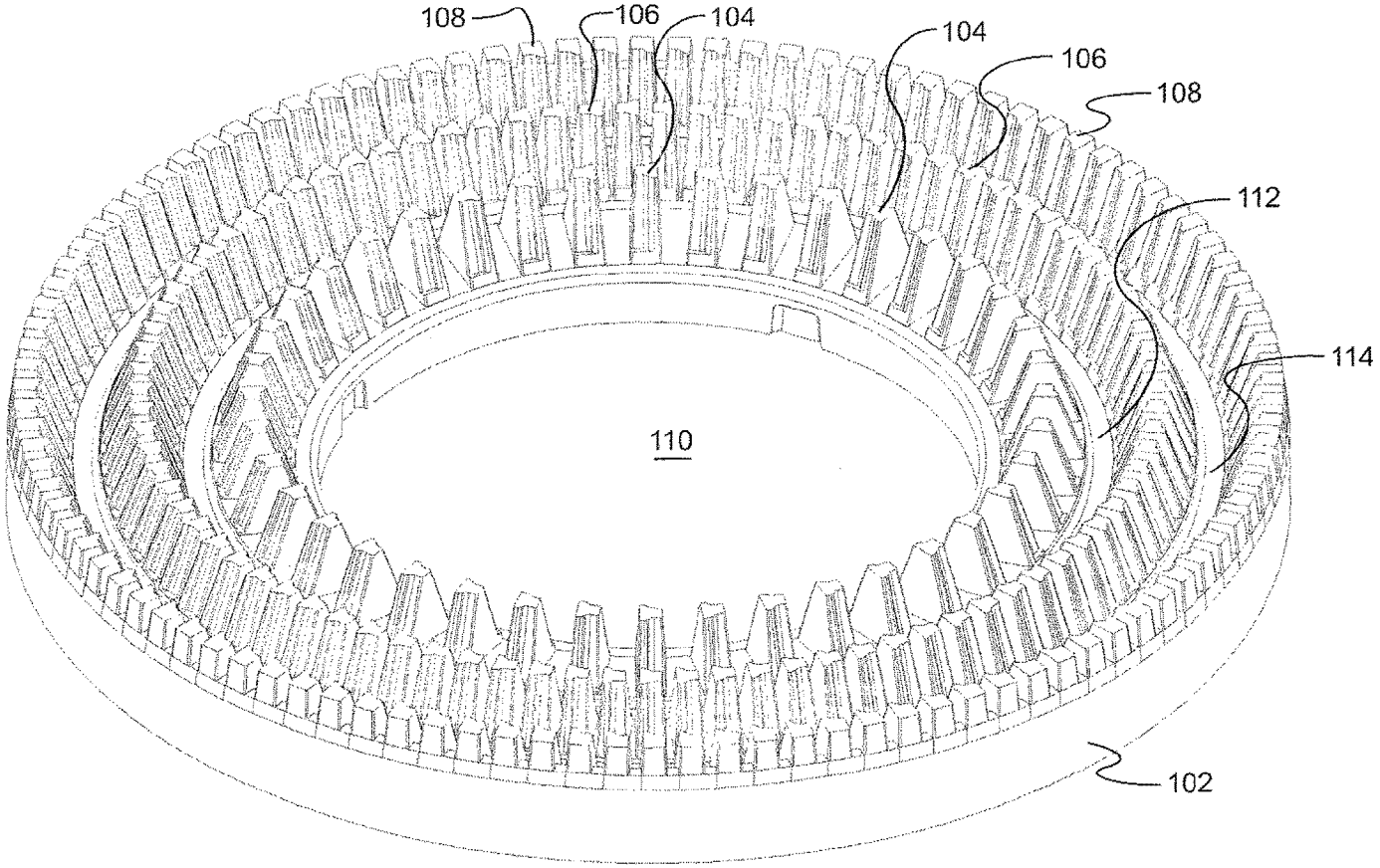
FIG. 1 is a schematic representation of a deflaker plate according to an aspect of the invention.

In an aspect, the invention relates to deflaker plates having surfaces of teeth that are not parallel (and perpendicular) to the axis of plate rotation. For example, the deflaker plates may have teeth that are not substantially cubic and instead are substantially trapezoidal or substantially triangular. That is, the teeth may have leading and trailing faces that each are substantially in the shape of a triangle or trapezoid. These shapes within the scope of certain aspects of the invention may affect the magnitude and direction of the hydraulic impulses during the sweeping process of rotor and stator teeth.

In certain embodiments, the teeth may form one, two, three, or more (e.g., five or ten) annular rings around each of the rotor and stator plates. Generally, the slurry flows from the center of the plates (which preferably may rotate counter relative to each other and/or, in some embodiments rotate at different frequencies or speeds) to the outer circumference, generally following a radial path. As the fiber flocs move along the generally radial path, the flocs are deflaked by the pressure pulses generated by the counter-rotating teeth.

Counter-rotating refers to rotation of the rotor relative to the stator and includes any configuration involving a relatively stationary rotor and a rotating rotor as well as configurations involving rotation of both the rotor and "stator." In some instances, it may be possible to rotate the "stator" and the rotor in the same direction at different speeds.

As the flocs are deflaked, the hydraulic pulses may produce forces that are not aligned with the radial movement. That is, forces may be generated that have a radial vector pushing the slurry back towards the center of the deflaker as well as a tangential vector pushing the slurry against the direction of rotation. The combined vector may be normal to the lateral surface of a tooth according to an embodiment of the invention.

In a preferred embodiment, the deflaker may operate on a slurry of 4-5% consistency, although any commercially viable consistency may be used. That is, the invention is not limited to the type and consistency of slurry requiring deflaking and passed through the deflaker.

For example, other fiber slurries suitable for use in connection with various embodiments include (i) hotstock from the outlet of boilers, where these plates could be used to achieve some shive reduction; (ii) fiber bundles near mixing plates where the hydraulic impulses are used to mix a suspension. Consistencies of suitable slurries may vary between 1% and 10-15% depending on the origination of the slurry entering the deflaker. By the design itself though, the creation of shear forces requires the fluidity of the slurry. Thus, any slurry that forms similar to a fluid may be used.

A deflaker plate may be made from any suitable material, such as a steel-based alloy. In preferred embodiments, alloys DC17 and XP from Andritz Pulp and Paper Mill Services may be particularly suitable for casting deflaker plates according to certain aspects of the invention. In principle, any suitable alloy can be used, including, for example, from stainless steel alloys, chrome white irons, Ni-Hard alloys, etc. In some embodiments, the alloys may have the following properties: a hardness of 30 to 60 HRC avg. and/or a 4-point-bend-test bend strength of 80 to 350 KSI avg.

FIG. 1 illustrates a deflaker plate 102 according to an aspect of the invention. As described in connection with FIG. 1 and as used throughout the present description, the term "deflaker" plate may refer to either a rotor plate or a stator plate. As illustrated, deflaker plate 102 includes a center 110 and substantially annual rings each comprising a plurality of teeth for disintegrating the fiber flocs as the slurry of comminuted fibers passes generally radially from center 110 to the outer circumference of deflaker plate 102. FIG. 1 shows three annular rings of first ring of teeth 104, second ring of teeth 106, and third ring of teeth 108. Each ring of teeth is separated by a generally flat surface 112 or 114. The separation need not be by a flat surface, rather any configuration that complements or mirrors the opposing deflaker plate (e.g., mirrors or complements the tops of the teeth of the opposing deflaker plate) may be employed.

As illustrated in FIG. 1, each annular ring of teeth may have greater or fewer numbers of teeth, with increased or decreased regular or irregular frequency. In some embodiments, inner rings will have the lowest number of teeth by default, as the radius is there the smallest and the propensity to "plug" with fibrous material the greatest. Thus those areas may have a few single teeth only. Outer rings may have (significantly) more teeth due to the increased radius, e.g., higher open area. The number of teeth ultimately depends on the gap between neighboring teeth and their width.

Although it may be important in some embodiments to balance the deflaker plate such that it has minimal wobble, not all embodiments require that the deflaker plate spin (e.g., stationary stator plates fixed to the deflaker). Accordingly, irregularly placed teeth may be employed in certain embodiments. That is, in some embodiments, the substantially annual rings may include one or more offset teeth that do not line up with the majority of the teeth.

Figure 2:
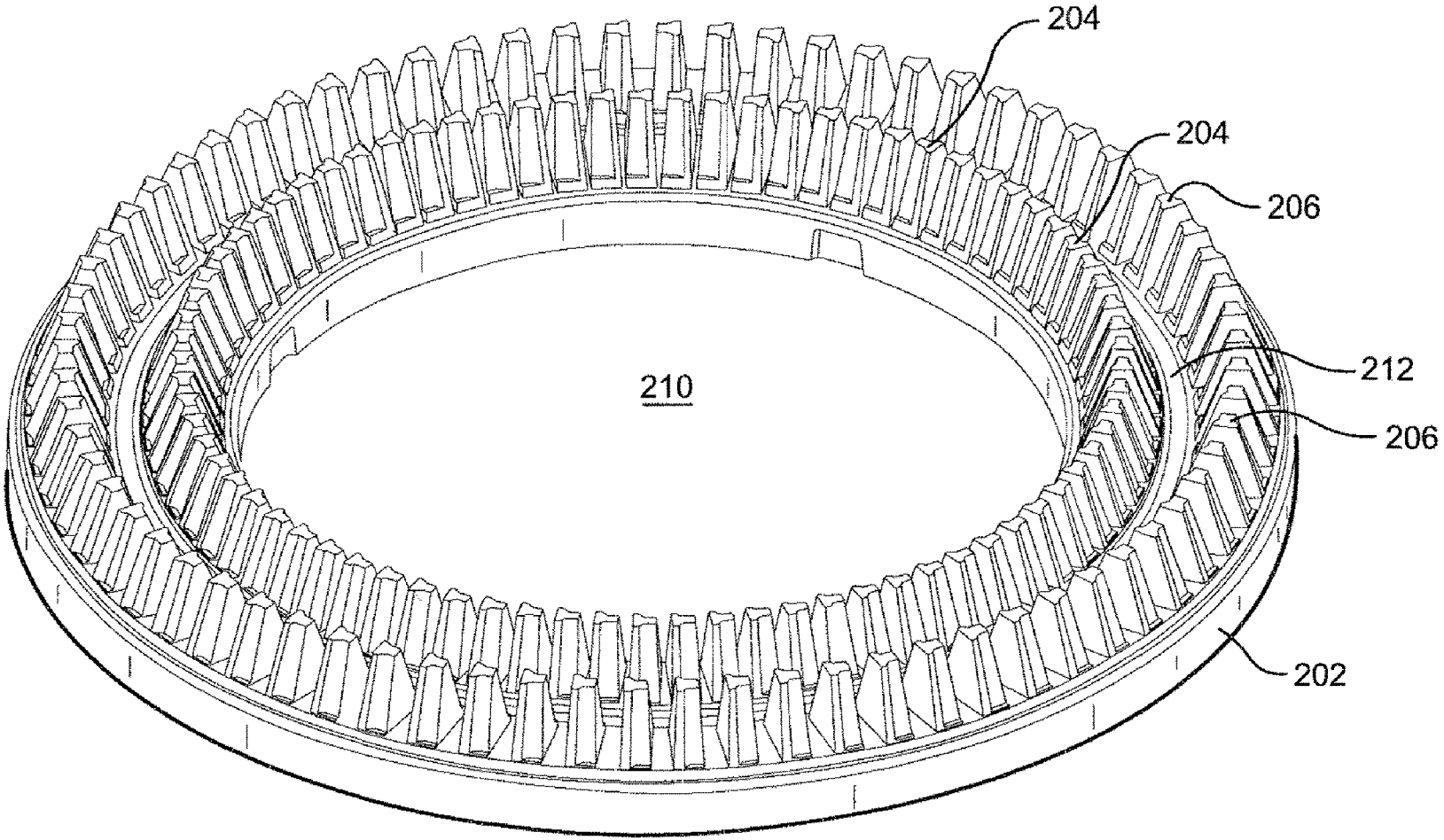
FIG. 2 is a schematic representation of a deflaker plate according to an aspect of the invention.

FIG. 2 illustrates a deflaker plate 202 according to an aspect of the invention. As illustrated, deflaker plate 202 includes a center 210 and substantially annular rings each comprising a plurality of teeth. FIG. 2 illustrates two annular rings: first ring of teeth 204, and second ring of teeth 206. The rings are separated by a generally flat surface 212.

Figure 3:
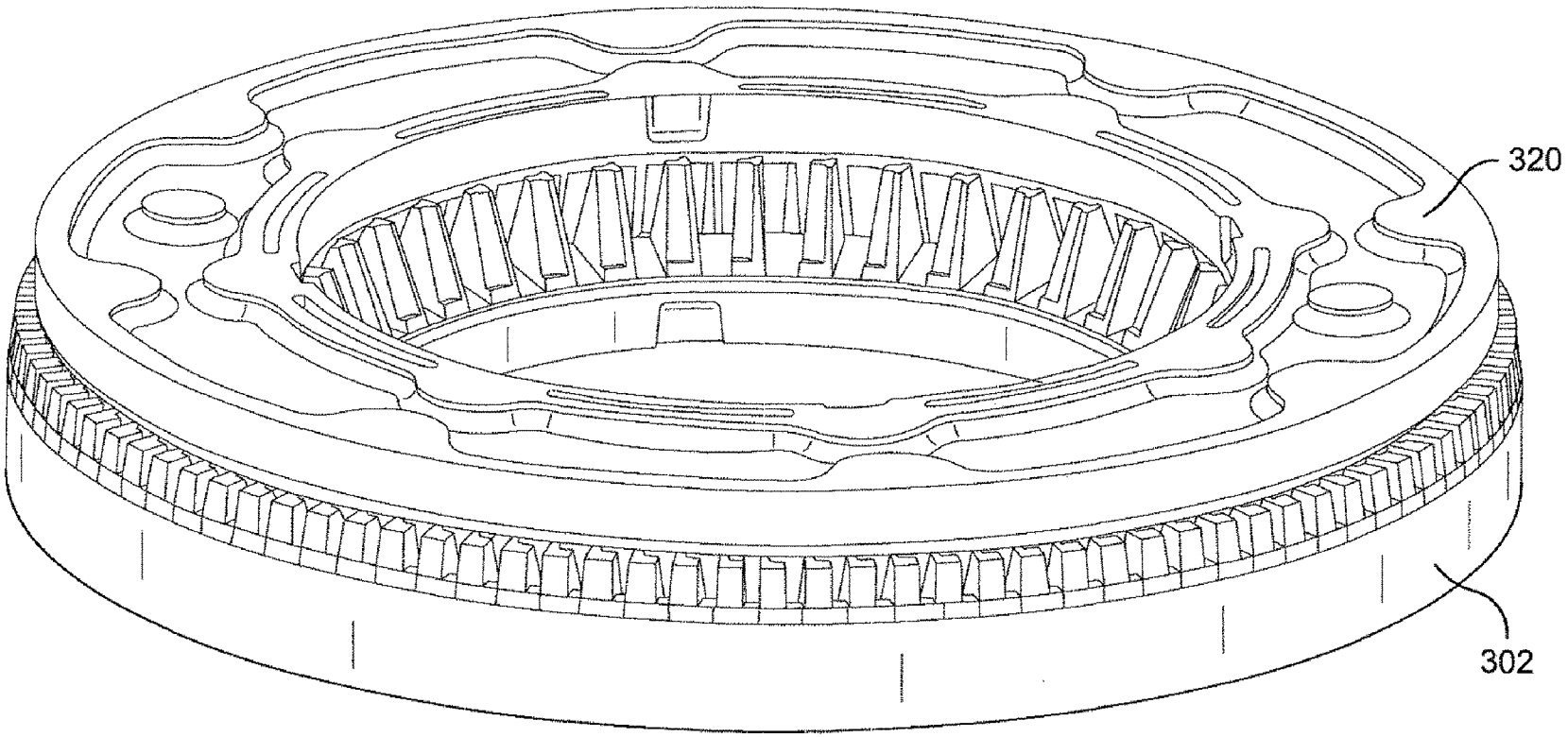
FIG. 3 is a schematic representation of a rotor plate and stator plate according to an aspect of the invention.

FIG. 3 illustrates a stator plate 302 and rotor plate 320. As shown, the stator and rotor plate complement or mirror each other such that their respective teeth do not contact each other during operation of the deflaker. In general, there may be a gap of less than 5 mm, and preferably less than 1.5 mm between the rotor and stator plates during operation. In certain embodiments, it may be possible to achieve a gap size of 0.3-0.4 mm or even 0.1 mm. In general, the smaller the gap, the more shear experienced by the slurry during deflaking. That is, the impulses caused by a small gap may improve the efficiency of the deflaking operation. In some embodiments, a gap of less than 0.1 mm may exist between the rotor and stator plates. (In determining gap distance, the distance between the plates may be measured while the plates are stationary.)

Figure 4:
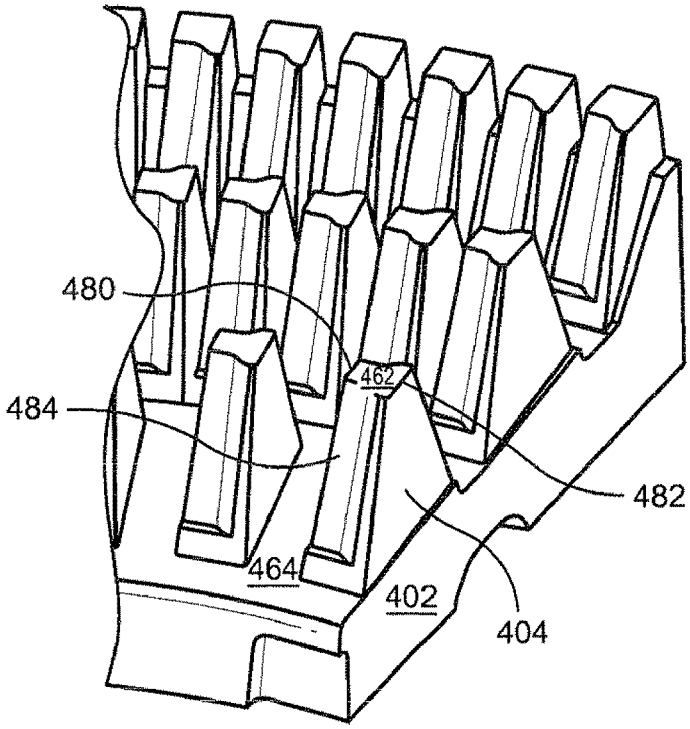
FIG. 4 is a schematic representation of a deflaker plate tooth according to an aspect of the invention.

FIG. 4 illustrates a deflaker plate tooth 404 on deflaker plate 402 according to an aspect of the invention. As illustrated, deflaker plate tooth 404 has a leading face 480, a trailing face 482, and an impact-generating side-face 484. Each tooth 404 is separated by generally flat surface 464, which is approximately planar along the radial of deflaker plate 402. As illustrated, both leading face 480 and trailing face 482 are substantially trapezoidal with substantially similar heights as measured from generally flat surface 464. That is, top surface 462 is in a plane substantially parallel to the plane of generally flat surface 464. Impact-generating side-face 484 has a surface that generates forces both radially pushing the slurry back towards the center of the deflaker as well as tangentially pushing the slurry towards the leading face. The combined vector may be normal to the impact-generating side-face 484 surface. As illustrated, top surface 462 is in the shape similar, though not identical to a trapezoid. The leading face and trailing face may each individually be substantially triangular, and the leading face and trailing face need not be the same shape as each other. The shape of top surface 462 is largely dictated by the shape of impact-generating side-face 484 surface.

Figure 5:
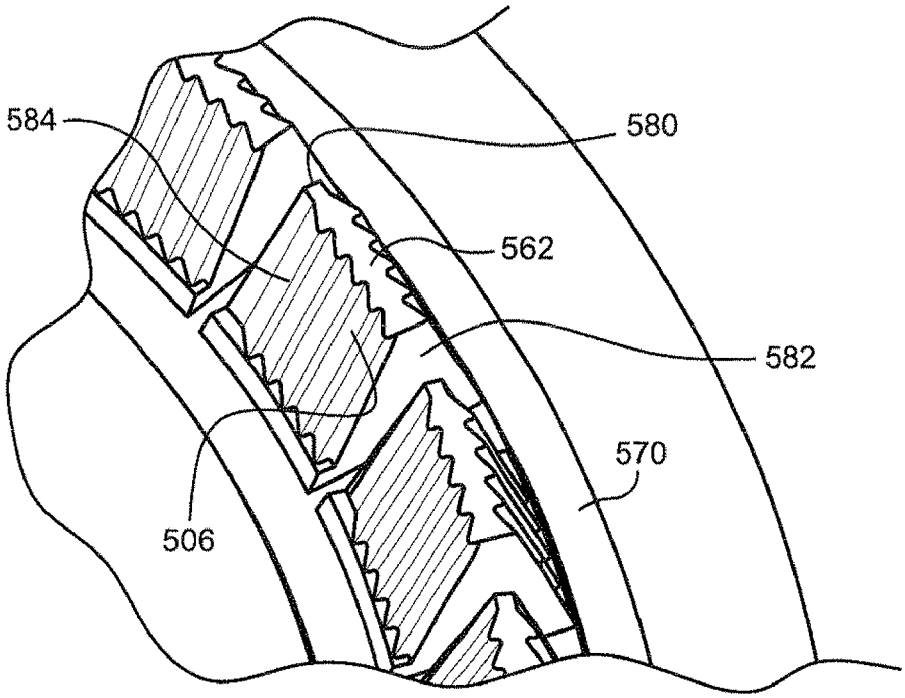
FIG. 5 is a schematic representation of a deflaker plate tooth according to an aspect of the invention.

FIG. 5 illustrates a deflaker plate tooth 506. As illustrated, deflaker plate tooth 506 has a leading face 580, a trailing face 582, and an impact-generating side-face 584. As illustrated, both leading face 580 and trailing face 582 are substantially trapezoidal with substantially similar heights as measured from generally flat surface 570. Generally flat surface 570 is approximately planar along the radial of deflaker plate (not numbered). That is, top surface 562 is in a plane substantially parallel to the plane of generally flat surface 570. Impact-generating side-face 584 has a saw-toothed surface that generates forces both radially pushing the slurry back towards the center of the deflaker as well as tangentially pushing the slurry towards the leading face. This saw-toothed configuration may facilitate the generation of micro-pulses by each tooth.

Figure 6:
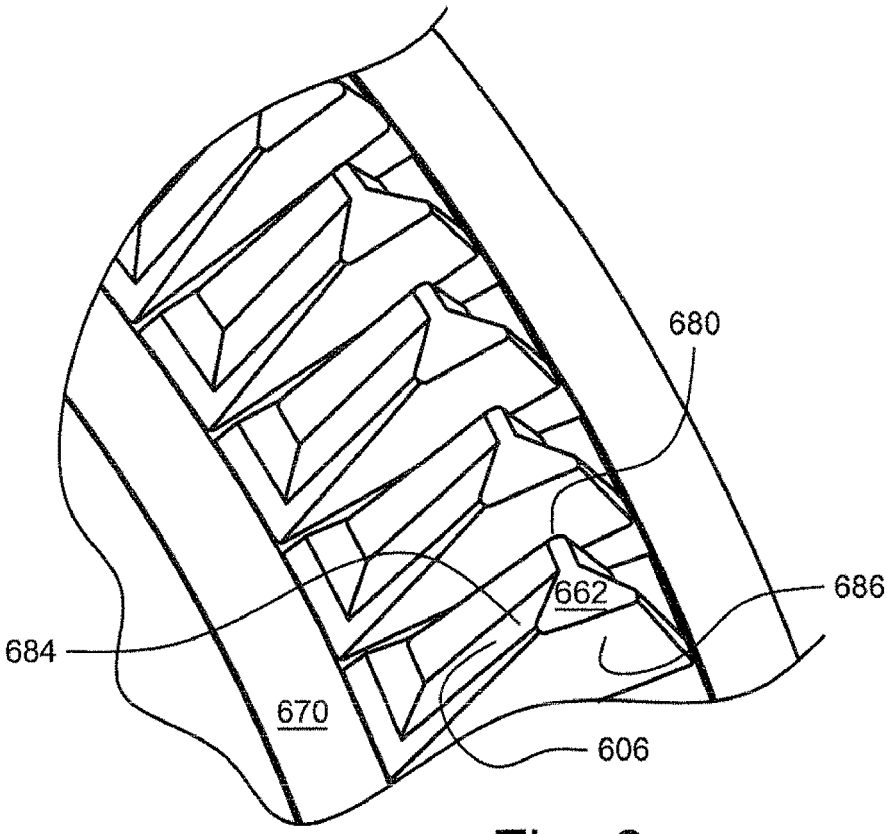
FIG. 6 is a schematic representation of a deflaker plate tooth according to an aspect of the invention.

FIG. 6 illustrates a deflaker plate tooth 606. As illustrated, deflaker plate tooth 606 has a leading face 680, a trailing face 686, and an impact-generating side-face 684. As illustrated, both leading face 680 and trailing face 686 are substantially trapezoidal with substantially similar heights as measured from generally flat surface 670. That is, top surface 662 is in a plane substantially parallel to the plane of generally flat surface 670. Impact-generating side-face 684 has a surface that generates forces both radially pushing the slurry back towards the center of the deflaker as well as tangentially pushing the slurry towards the leading face. Top surface 662, whose shape is largely irrelevant to certain aspects of the invention, is substantially trapezoidal (and is nearly triangular). As illustrated, impact-generating side-face 684 may include more than one portion, such that the impact-generating side-face is formed from intersecting planar faces.

Figure 7:
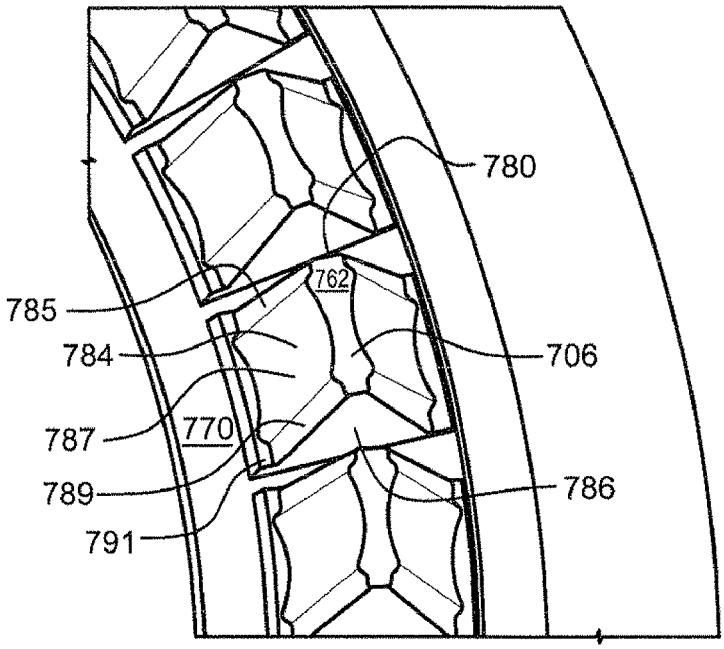
FIG. 7 is a schematic representation of a deflaker plate tooth according to an aspect of the invention.

FIG. 7 illustrates a deflaker plate tooth 706. As illustrated, deflaker plate tooth 706 has a leading face 780, a trailing face 786, and an impact-generating side-face 784. As illustrated, both leading face 780 and trailing face 786 are substantially trapezoidal with substantially similar heights as measured from generally flat surface 770. That is, top surface 762 is in a plane substantially parallel to the plane of generally flat surface 770. Impact-generating side-face 784 has a surface that generates forces both radially pushing the slurry back towards the center of the deflaker as well as tangentially pushing the slurry towards the leading face.

As illustrated, impact-generating side-face 784 has a curvilinear surface including a first curved portion 785, a second curved portion 787, and third curved portion 789. These portions together define a singular surface of the impact-generating side-face. In some instances, these surfaces may be substantially parabolic.

Deflaker plate tooth 706 also has a base portion 791, which may be substantially trapezoidal or cubic (and may be present in other embodiments as well). This base portion may increase the durability and/or stability of the deflaker plate tooth. The base portion may be of any shape (e.g., substantially rectangular).

If the plates are cast, it is likely that the base and the teeth will be of the same material. But if the teeth are glued or welded onto the base, then different materials are possible in various embodiments. The height of the bars may be from a few millimeters to 25 or 30 mm (or more in other embodiments). The maximum applicable tooth height depends on the design of the deflaker (adjustment mechanism, overall plate thickness) and on the breakage resistance of the material used. Persons of ordinary skill in the art will understand the number of variations on tooth dimensions depends on the particular application.

Figure 8:
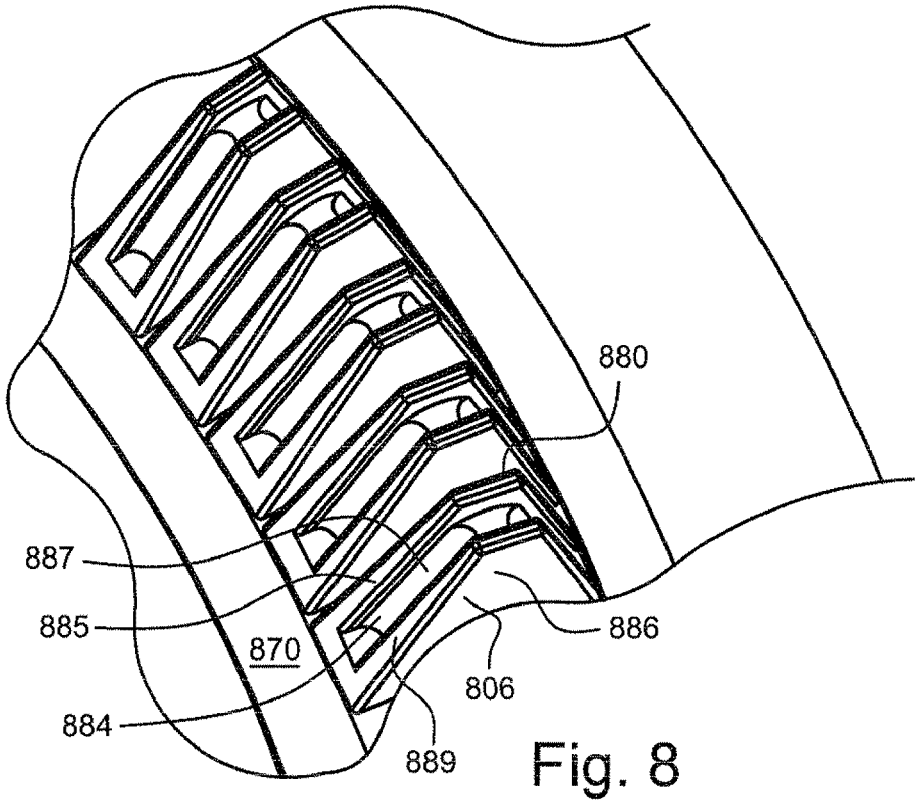
FIG. 8 is a schematic representation of a deflaker plate tooth according to an aspect of the invention.

FIG. 8 illustrates a deflaker plate tooth 806. As illustrated, deflaker plate tooth 806 has a leading face 880, a trailing face 886, and an impact-generating side-face 884. As illustrated, both leading face 880 and trailing face 886 are substantially trapezoidal with substantially similar heights as measured from generally flat surface 870. Impact-generating side-face 884 has a surface that generates forces both radially pushing the slurry back towards the center of the deflaker as well as tangentially pushing the slurry towards the leading face. Impact-generating side-face 884 has three portions: a first portion 887 adjacent to leading face 880, a third portion 889 adjacent trailing face 886, and second portion 887 adjacent the first and third portions. The first and third portions are substantially planar along the edges of leading face 880 and trailing face 886, while the second portion forms a substantially half-column carved out from that planar surface. In this embodiment, the top surface of tooth 806 is not substantially planar, although portions of tooth 806 are parallel to generally flat surface 870.

Figure 9:
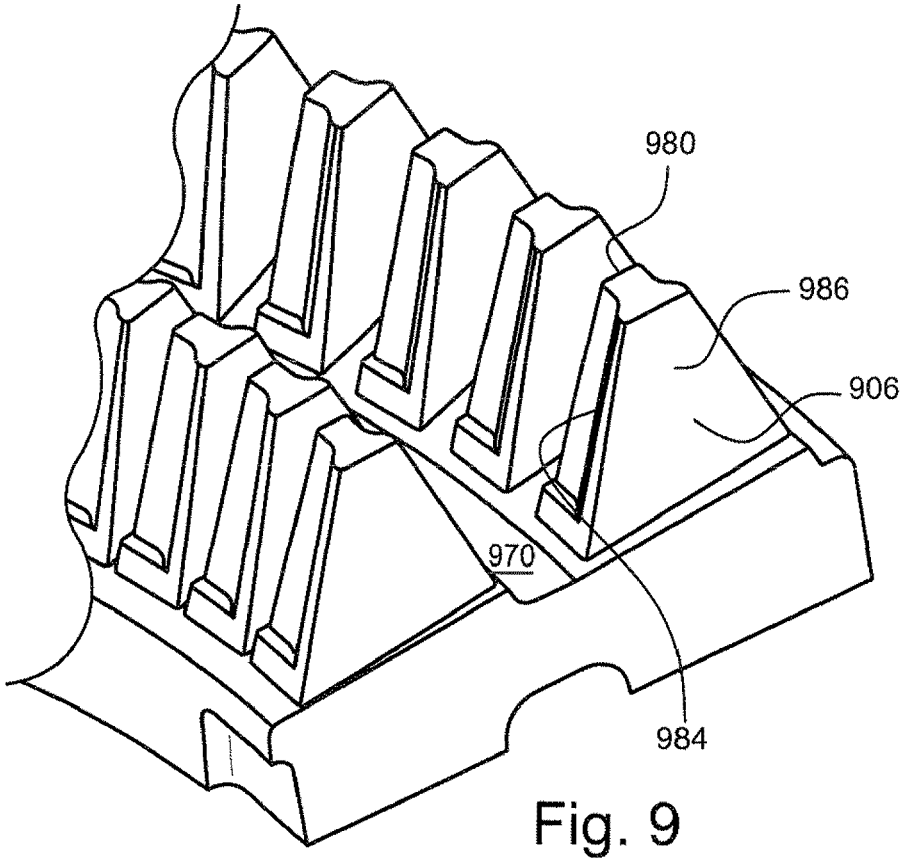
FIG. 9 is a schematic representation of a deflaker plate tooth according to an aspect of the invention.

FIG. 9 illustrates a deflaker plate tooth 906. As illustrated, deflaker plate tooth 906 has a leading face 980, a trailing face 986, and an impact-generating side-face 984. As illustrated, both leading face 980 and trailing face 986 are substantially trapezoidal with substantially similar heights as measured from generally flat surface 970. Impact-generating side-face 984 has a surface that generates forces both radially pushing the slurry back towards the center of the deflaker as well as tangentially pushing the slurry towards the leading face. Impact-generating side-face 984 has a surface similar to the impact-generating side-face illustrated in FIG. 4, and FIG. 9 shows two annular rings of deflaker teeth. As illustrated the surface area of leading face 980 is less than the surface area of trailing face 986. That is, trailing face 986 is larger than leading face 980.

Figure 10:
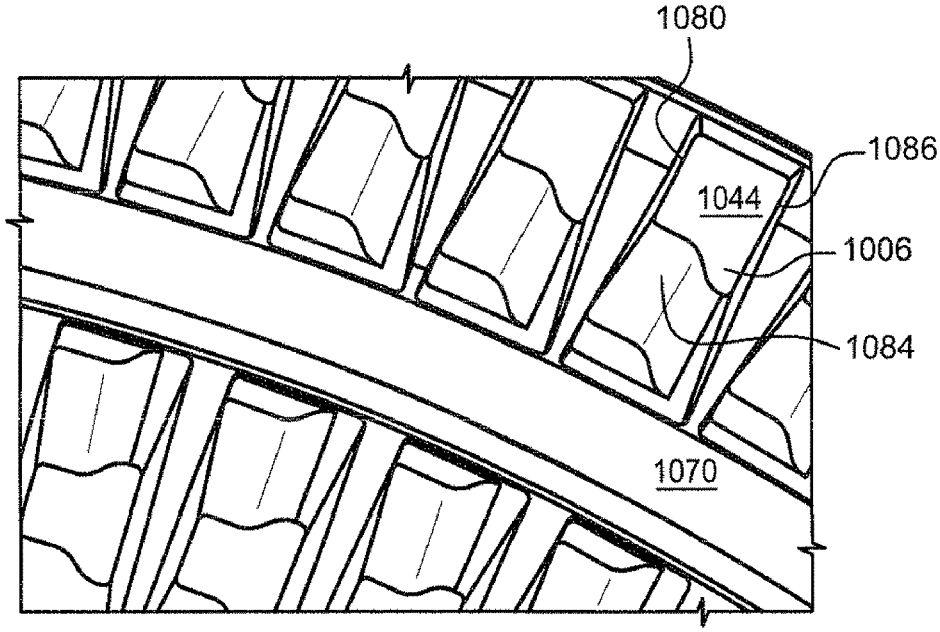
FIG. 10 is a schematic representation of a deflaker plate tooth according to an aspect of the invention.

FIG. 10 illustrates a deflaker plate tooth 1006. As illustrated, deflaker plate tooth 1006 has a leading face 1080, a trailing face 1086, an impact-generating side-face 1084, and a top surface 1044. As illustrated, both leading face 1080 and trailing face 1086 are substantially trapezoidal with substantially similar heights as measured from generally flat surface 1070. Impact-generating side-face 1084 has a surface that generates forces both radially pushing the slurry back towards the center of the deflaker as well as tangentially pushing the slurry towards the leading face. As illustrated the surface area of leading face 1080 is less than the surface area of trailing face 1086. That is, trailing face 1086 is larger than leading face 1080. Top surface 1044 has one side that is curvilinear (i.e., the side defined by the intersection with impact-generating side-face 1084) and the remaining three sides are substantially straight and defined by intersections with leading face 1080, a trailing face 1086, and outer face (not labeled). Deflaker plate tooth 1006 is illustrated in the outermost annular ring of the deflaker plate.

Figure 11:
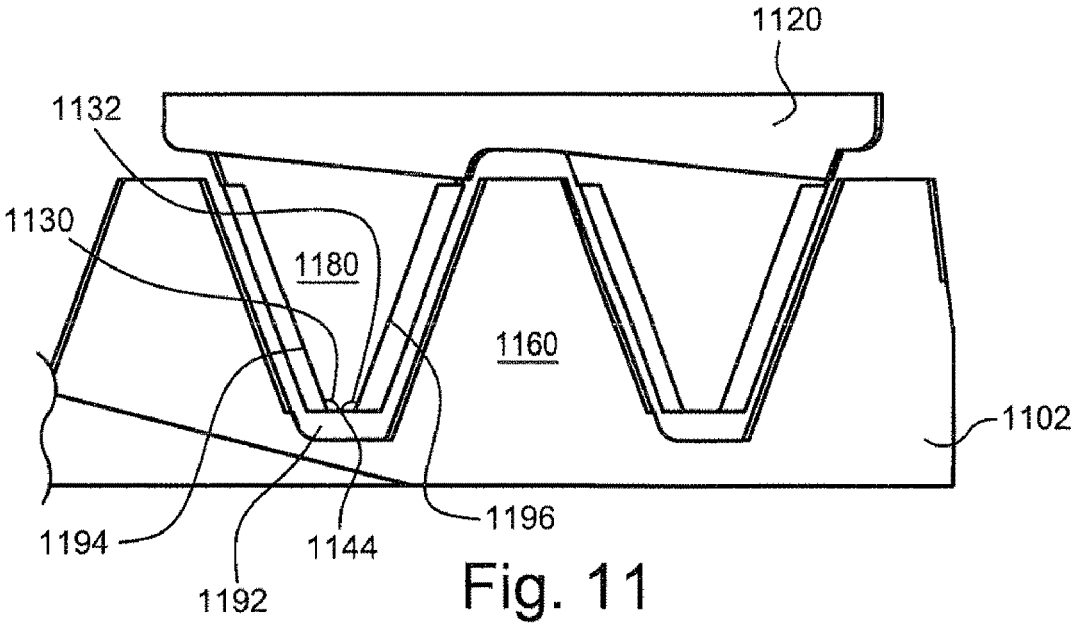
FIG. 11 is a schematic representation of a cross-sectional view of a rotor plate and stator plate according to an aspect of the invention.

FIG. 11 illustrates a side-view of a stator plate 1120 and rotor plate 1102 in accordance with an aspect of the invention. Rotor plate 1102 includes tooth 1160, and stator plate 1120 includes tooth 1180. Gap 1192 (which may be less than 1.5 mm and most preferably about 0.1 mm or less) resides between rotor plate 1102 and stator plate 1120. Gap 1192 carries the fibrous slurry through the deflaker.

Tooth 1180 has a leading face defined by a first leading edge 1194 (which connects to an impact-generating side-face), a top edge 1144 (which connects to a top face of tooth 1180), and a second leading edge 1196 (which connects to another impact-generating side-face). A first angle 1130 (defined by edge 1194 and edge 1144) is greater than or equal to 90% and a second angle 1132 (defined by edge 1144 and edge 1196) is also greater than or equal to 90°. These angles are preferably greater then 100% greater than 110% greater than 120% greater than 130% or any angle less than 180°.

Figure 12:
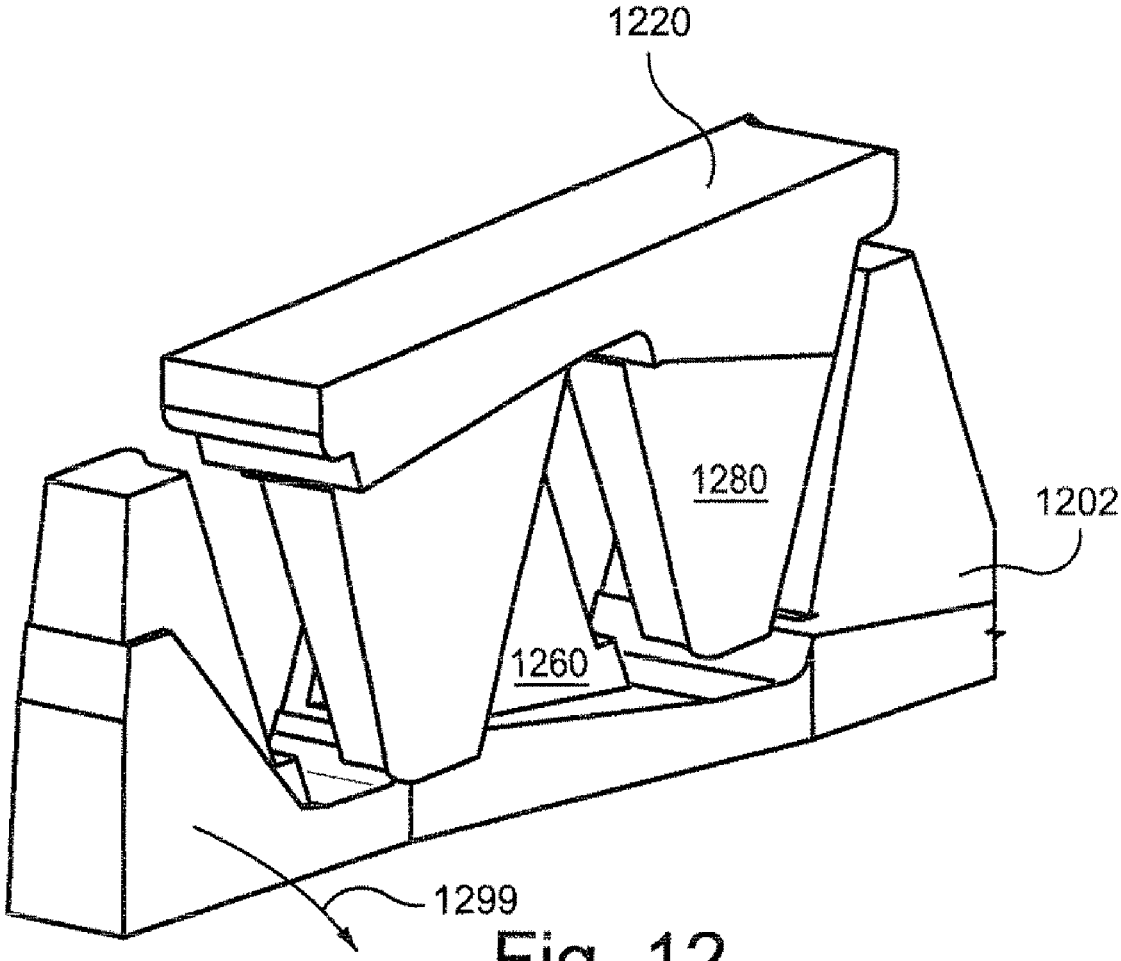
FIG. 12 is a schematic representation of a perspective view of a rotor plate and stator plate according to an aspect of the invention.

FIG. 12 illustrates a perspective view of a stator plate 1220 and rotor plate 1202 in accordance with an aspect of the invention. Rotor plate 1202 includes tooth 1260, and stator plate 1220 includes tooth 1280. As illustrated, rotor plate 1202 moves in the direction of arrow 1299 relative to stator plate 1220.

In an aspect, therefore, the deflaker plates facilitate novel directions for impulse vectors due to the inclination of the interfacing surfaces of the stator and rotor plates. This may facilitate tailoring deflaking shear forces according to particular intended use (e.g., the type of fiber flocs requiring deflaking).

The ability to change the direction of the impulse during the sweeping process may allow for the ability to direct the pulse at the fibers being treated in the intersection zone leading to a turbulence level different from currently available designs.

The application of casting technology may facilitate elongating the intersection length versus the conventional precision machined designs, which generally require straight flanks perpendicular to a radial originating at the center of the deflaker. This may increase the stability of teeth and possibly also their durability. For example, cast teeth may have improved breakage resistance. In certain embodiments, casting may facilitate particular adjustment of the gap between the side flanks of the teeth (e.g., via shimming). This, in turn, may improve the ability to tailor or adjust the deflaking process according to particular slurry composition and consistency.

Any suitable casting process known to those skilled in the art may be used. For example, a suitable investment casting process may include one or more of the following steps: (1) forming a master pattern; (2) making a master die from the master pattern (or making a master die directly without first forming a master pattern); (3) making a pattern (e.g., a "wax" pattern); (4) forming an "investment" mold (e.g., a ceramic mold), including removal of residual wax and/or impurities; (5) pouring molten metal into the mold, e.g., via gravity, vacuum (e.g., negative) pressure, positive pressure, centrifugal force, etc.; and (6) removing the solidified metal from the cast, then grinding/polishing if desirable.

It should be understood, however, that the present invention is not limited or defined by the casting process. That is, any manufacturing technique may be used to produce the deflaker plates as described herein.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. A deflaker plate for use in a deflaker for reducing fibrous flakes in a slurry of fibers, the deflaker plate comprising:

at least one annular ring consisting of multiple teeth, the at least one annular ring comprising at least one tooth having a leading face, a trailing face, and an impact-generating side-face, wherein the at least one tooth has a base portion supporting the at least one tooth on the deflaker plate so as to increase the durability or stability of the at least one tooth, the base portion being substantially cubic, and wherein the impact-generating side-face is adapted to generate an impact force having a first force vector radially pushing the slurry towards a center of the deflaker and a second force vector tangentially pushing the slurry towards the leading face.

2. The deflaker plate of claim 1, wherein the leading face or the trailing face is substantially trapezoidal.

3. The deflaker plate of claim 2, wherein the leading face has a first surface area and the trailing face has a second surface area, and wherein the second surface area is larger than the first surface area.

4. The deflaker plate of claim 1, wherein the leading face or the trailing face is substantially triangular.

5. The deflaker plate of claim 1, wherein the impact-generating side-face has a saw-toothed surface.

6. The deflaker plate of claim 1, wherein the impact-generating side-face has a curvilinear surface comprising at least one curved portion.

7. The deflaker plate of claim 6, wherein the curvilinear surface comprises three curved portions.

8. The deflaker plate of claim 1, wherein the top surface of the at least one tooth is not substantially planar.

9. The deflaker plate of claim 1, wherein the at least one tooth comprises a first leading edge defined by the intersection of the leading face with the impact-generating side-face, and a top edge defined by the intersection of a top face of the at least one tooth, wherein a first angle is defined at the intersection of the first leading edge and the top edge, and wherein the first angle is greater than or equal to 90° .

10. The deflaker plate of claim 9, wherein the first angle is less than 180° .

11. The deflaker plate of claim 10, wherein the first angle is greater than 110° .

12. A complementary set of deflaker plates for use in a deflaker for reducing fibrous flakes in a slurry of fibers, the complementary set of deflaker plates comprising:

a rotor deflaker plate and a stator deflaker plate, wherein the rotor deflaker plate and the stator deflaker plate each comprise at least one annular ring consisting of multiple teeth, wherein the at least one annular ring of at least one of the rotor deflaker plate and the stator deflaker plate comprises at least one tooth having a leading face, a trailing face, and an impact-generating side-face, wherein the at least one tooth has a base portion supporting the at least one tooth on the deflaker plate so as to increase the durability or stability of the at least one tooth, the base portion being substantially cubic, wherein the impact-generating side-face is adapted to generate an impact force having a first force vector radially pushing the slurry towards a center of the deflaker and a second force vector tangentially pushing the slurry towards the leading face, wherein a gap is defined between the rotor deflaker plate and the stator deflaker plate when the rotor deflaker plate and the stator deflaker plate are mounted in the deflaker, and wherein the gap has a gap distance of 5.0 mm or less.

13. The complementary set of deflaker plates of claim 12, wherein the gap distance is 1.5 mm or less.

14. The complementary set of deflaker plates of claim 12, wherein the gap distance is 0.4 mm or less.

15. A deflaker plate for use in a deflaker for reducing fibrous flakes in a slurry of fibers, the deflaker plate comprising:

at least one annular ring consisting of multiple teeth, the at least one annular ring comprising at least one tooth having a leading face, a trailing face, and an impact-generating side-face, wherein the top surface of the at least one tooth is not substantially planar, and wherein the impact-generating side-face is adapted to generate an impact force having a first force vector radially pushing the slurry towards a center of the deflaker and a second force vector tangentially pushing the slurry towards the leading face.

16. A deflaker plate for use in a deflaker for reducing fibrous flakes in a slurry of fibers, the deflaker plate comprising:

at least one annular ring consisting of multiple teeth, the at least one annular ring comprising at least one tooth having a leading face, a trailing face, and an impact-generating side-face, wherein the impact-generating side-face is adapted to generate an impact force having a first force vector radially pushing the slurry towards a center of the deflaker and a second force vector tangentially pushing the slurry towards the leading face, and wherein the impact generating side face comprises a first portion adjacent to leading face, a third portion adjacent trailing face, and second portion adjacent the first and third portions, and wherein the first and third portions are substantially planar along the edges of the leading face and the trailing face, and wherein the second portion comprises a carved out portion from the plane defined by the first and third portions.

* * * * *